US007837037B2

(12) United States Patent
McTavish et al.

(10) Patent No.: US 7,837,037 B2
(45) Date of Patent: Nov. 23, 2010

(54) TWO STACKING POSITION SQUARE CONTAINER

(75) Inventors: Gordon McTavish, Sherwood Park (CA); Cory Koski, Edmonton (CA); Hongqiao Li, Edmonton (CA)

(73) Assignee: Drader Manufacturing Industries Ltd., Edmonton (CA)

( * ) Notice: Subject to any disclaimer, the term of this patent is extended or adjusted under 35 U.S.C. 154(b) by 843 days.

(21) Appl. No.: 11/614,016

(22) Filed: Dec. 20, 2006

(65) Prior Publication Data

US 2008/0047864 A1 Feb. 28, 2008

(30) Foreign Application Priority Data

Dec. 22, 2005 (CA) ..... 2532266

(51) Int. Cl.
*B65D 21/02* (2006.01)
*B65D 90/02* (2006.01)

(52) U.S. Cl. ..... 206/509; 220/675

(58) Field of Classification Search ..... 206/507, 206/505, 504; 220/23.86, 23.6, 631, 659, 220/657, 656, DIG. 2, 660; D9/430, 414; *B65D 21/036, B65D 21/032, 21/02*

See application file for complete search history.

(56) References Cited

U.S. PATENT DOCUMENTS 2,599,727 A * 6/1952 Schmidt ..... 206/507
2,852,157 A * 9/1958 Frater ..... 206/507
2,889,072 A * 6/1959 Lapham ..... 206/507
3,270,913 A * 9/1966 Bridenstine et al. ..... 206/507
3,326,410 A * 6/1967 Asenbauer ..... 206/504
3,331,529 A * 7/1967 Slapnik ..... 206/508
3,387,740 A 6/1968 Bockenstette
3,420,402 A * 1/1969 Frater et al. ..... 206/507
3,430,806 A * 3/1969 Munk et al. ..... 206/507
3,438,544 A * 4/1969 Cloyd ..... 206/596
3,675,815 A 7/1972 Rehrig
3,780,905 A 12/1973 Heroizer
4,000,817 A 1/1977 Sanders
4,139,098 A * 2/1979 Mollon ..... 206/507
4,205,749 A * 6/1980 Carroll et al. ..... 206/507
4,316,540 A * 2/1982 Lapham ..... 206/507
4,416,374 A * 11/1983 Smith et al. ..... 206/507
4,426,001 A 1/1984 Stahl
4,960,207 A 10/1990 Tabler
5,035,326 A 7/1991 Stahl
5,287,966 A 2/1994 Stahl (Continued)

*Primary Examiner*—Anthony Stashick
*Assistant Examiner*—Robert J Hicks
(74) *Attorney, Agent, or Firm*—Christensen O'Connor Johnson Kindness PLLC

(57) ABSTRACT

A two stacking position square container is provided having an upper stacking position and a lower stacking position. The upper stacking position is provided by inserting a bottom of an identical body into a square opening to provide lateral stability and engaging supports on a bottom exterior profile with supports on a top interior profile. A lower stacking position is provided by inserting the bottom of the identical body into the square opening to provide lateral stability and engaging the supports on the bottom exterior profile with recesses on the top interior profile and the supports on the upper interior profile with recesses on the bottom interior profile. The body is symmetrical about both an x axis and a y axis. A 90 degree relative rotation about a z axis being used to change between the upper stacking position and the lower stacking position.

4 Claims, 9 Drawing Sheets

U.S. PATENT DOCUMENTS 5,881,902 A 3/1999 Ackermann
6,273,259 B1 8/2001 Stahl
6,394,274 B1 5/2002 Cheeseman

* cited by examiner

FIG. 3
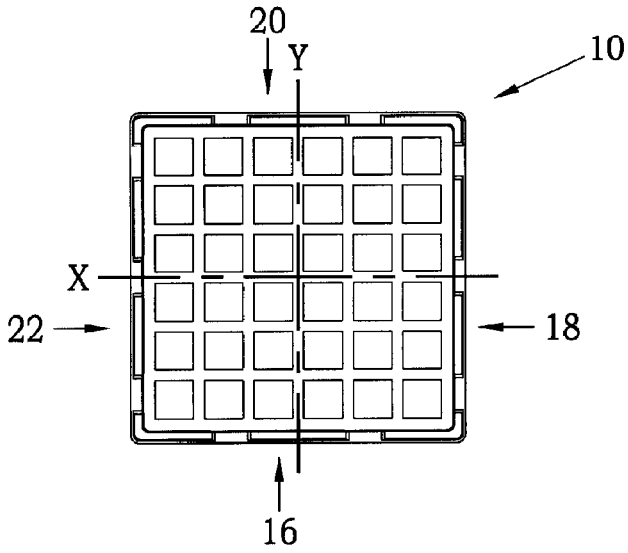
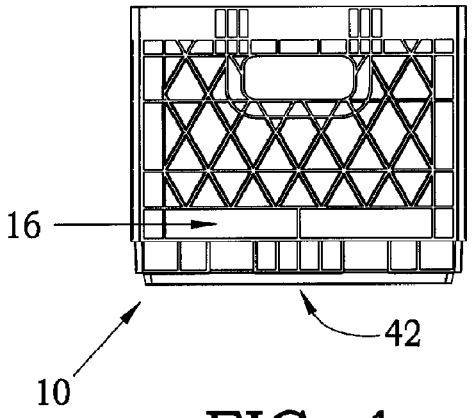
FIG. 4
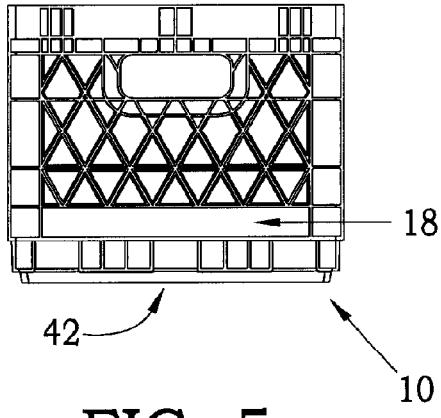
FIG. 5

TWO STACKING POSITION SQUARE CONTAINER

FIELD OF THE INVENTION

The present invention relates to a stacking square container, such as it commonly used in the dairy industry.

BACKGROUND OF THE INVENTION

Two position stacking containers have been used for years in the bakery industry. Examples of patents relating to two position stacking containers in use in the bakery industry include: U.S. Pat. No. 4,000,817 (Sanders et al 1977); U.S. Pat. No. 5,035,326 (Stahl 1991); U.S. Pat. No. 5,287,966 (Stahl 1994); U.S. Pat. No. 6,273,259 (Stahl 2001) and U.S. Pat. No. 6,394,274 (Cheeseman 2002). Two position stacking containers are not presently used in the dairy industry.

SUMMARY OF THE INVENTION

According to the present invention there is provided a two stacking position square container which provides an upper stacking position and a lower stacking position. The upper stacking position is provided by inserting a bottom of an identical body into a square opening to provide lateral stability and engaging supports on a bottom exterior profile with supports on a top interior profile. A lower stacking position is provided by inserting the bottom of the identical body into the square opening to provide lateral stability and engaging the supports on the bottom exterior profile with recesses on the top interior profile and the supports on the upper interior profile with recesses on the bottom interior profile. The body is symmetrical about both an x axis and a y axis. A 90 degree relative rotation about a z axis being used to change between the upper stacking position and the lower stacking position.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

FIG. 3 is a top plan view of the two stacking position square container illustrated in FIG. 1.

FIG. 4 is a first side elevation view of the two stacking position square container illustrated in FIG. 1.

FIG. 5 is a second side elevation view of the two stacking position square container illustrated in FIG. 1.

DETAILED DESCRIPTION OF THE PREFERRED EMBODIMENT

Figure 1:
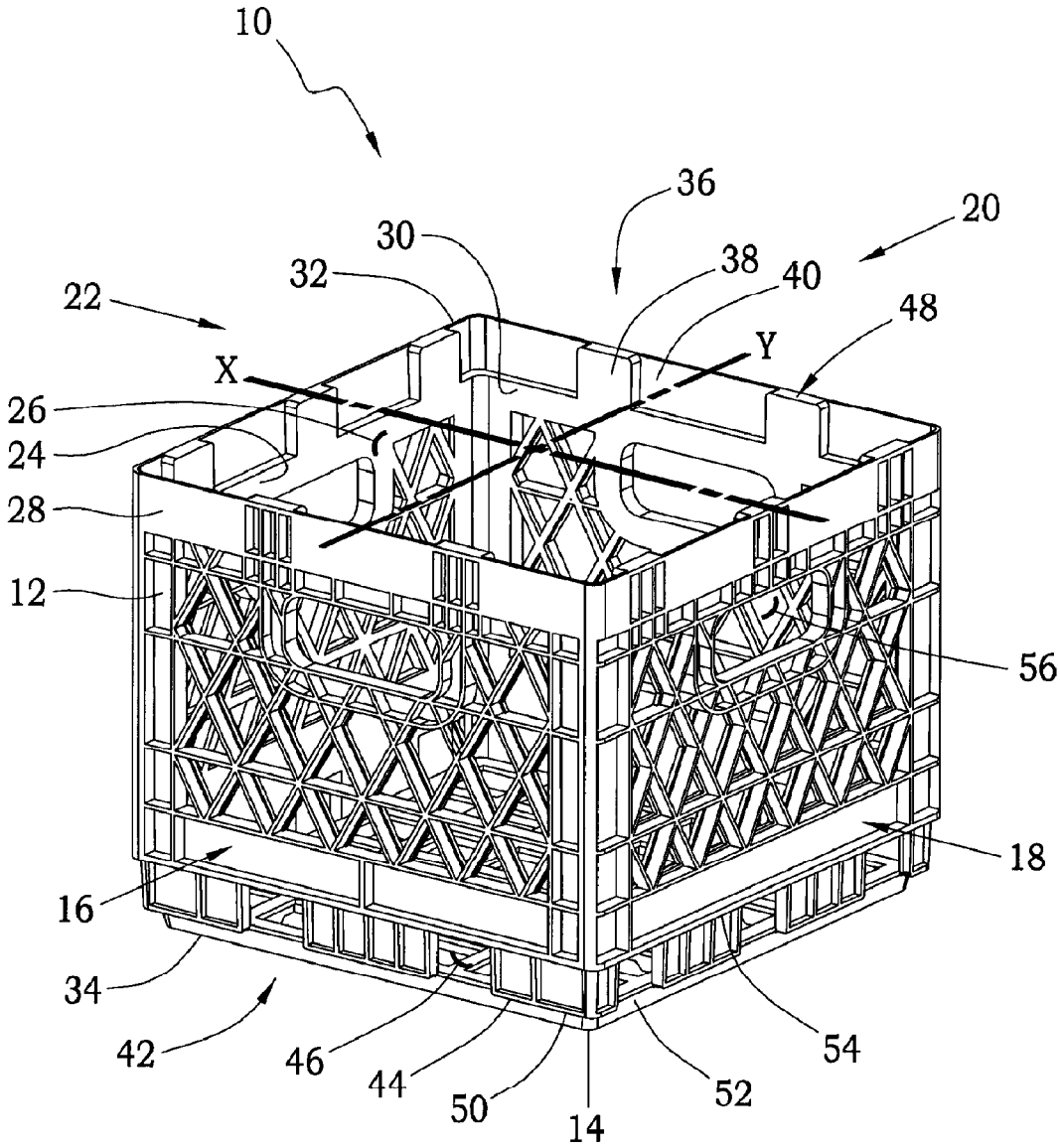
FIG. 1 is a top perspective view of a two stacking position square container constructed in accordance with the teachings of the present invention.

The preferred embodiment, a two stacking position square container generally identified by reference numeral 10, will now be described with reference to FIG. 1 through 11.

Figure 2:
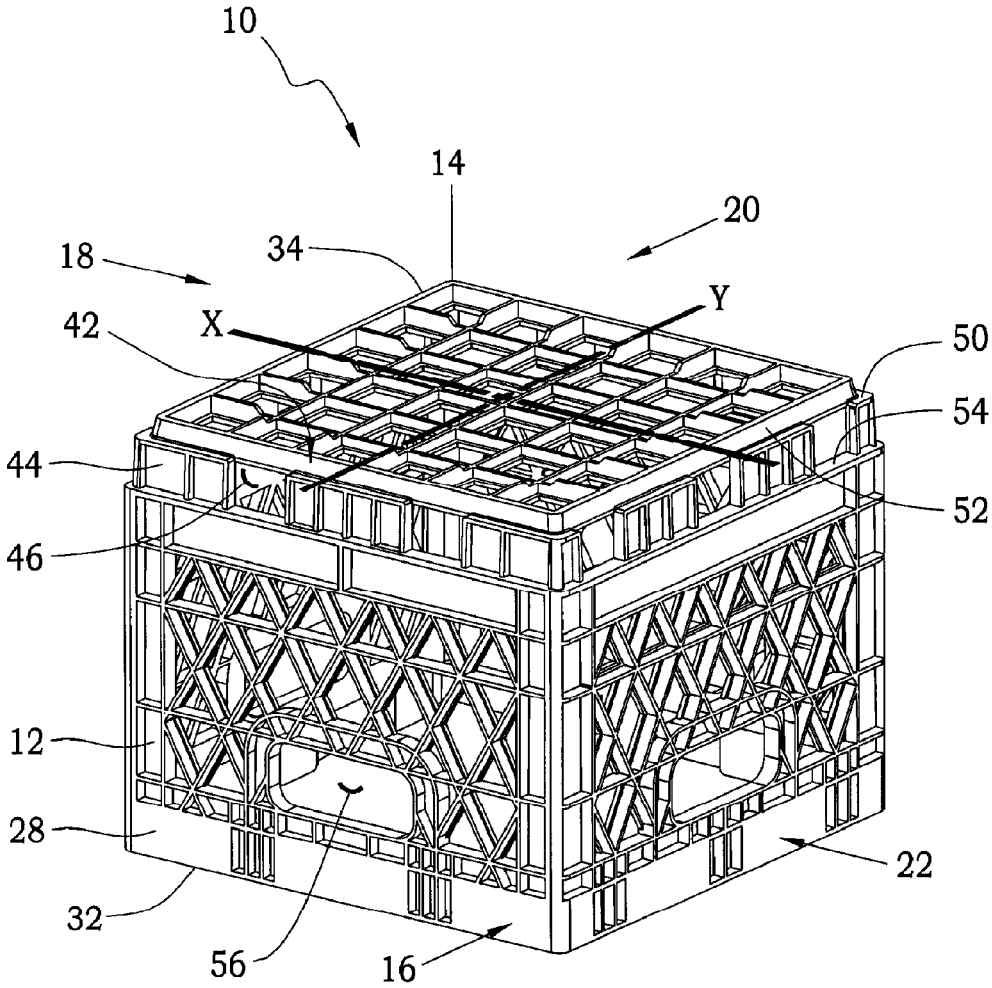
FIG. 2 is a bottom perspective view of the two stacking position square container illustrated in FIG. 1.

Structure and Relationship of Parts:

Referring to FIG. 1 and FIG. 2, two stacking position square container 10 consists of a one piece integrally moulded body 12 having a bottom 14 with four side walls 16, 18, 20, and 22 of equal length and height extending upwardly from bottom 14 to a define a square opening 24 into an interior storage cavity 26. Each of four side walls 16, 18, 20 and 22 has an exterior surface 28, an interior surface 30, a top peripheral edge 32 and a bottom peripheral edge 34. Each of four side walls 16, 18, 20, and 22 have an intermittent top interior profile, generally indicated by reference numeral 36, which consists of support members 38 separated by recesses 40 positioned along top peripheral edge 32. Recesses 40 are open toward interior surface 30 and open toward top peripheral edge 32 to allow for insertion of an overlying container, as will hereinafter be further described. Each of four side walls 16, 18, 20, and 22 also has an intermittent bottom exterior profile, generally indicated by reference numeral 42 of support members 44 separated by recesses 46 along bottom peripheral edge 34. Recesses 46 are open toward exterior surface 28 and open toward bottom peripheral edge 34 to allow for insertion of an underlying container, as will hereinafter be further described.

A continuous planar top exterior profile, generally indicated by reference numeral 48 is provided along top peripheral edge 32. A first engagement surface 50 is provided by a lower extremity of support members 44. First engagement surface 50 is spaced from bottom peripheral edge 34 leaving a peripheral band 52 that surrounds bottom 14 below bottom exterior profile 42. A second engagement shoulder 54 is provided which is spaced from bottom peripheral edge 34 above bottom exterior profile 42.

Figure 8:
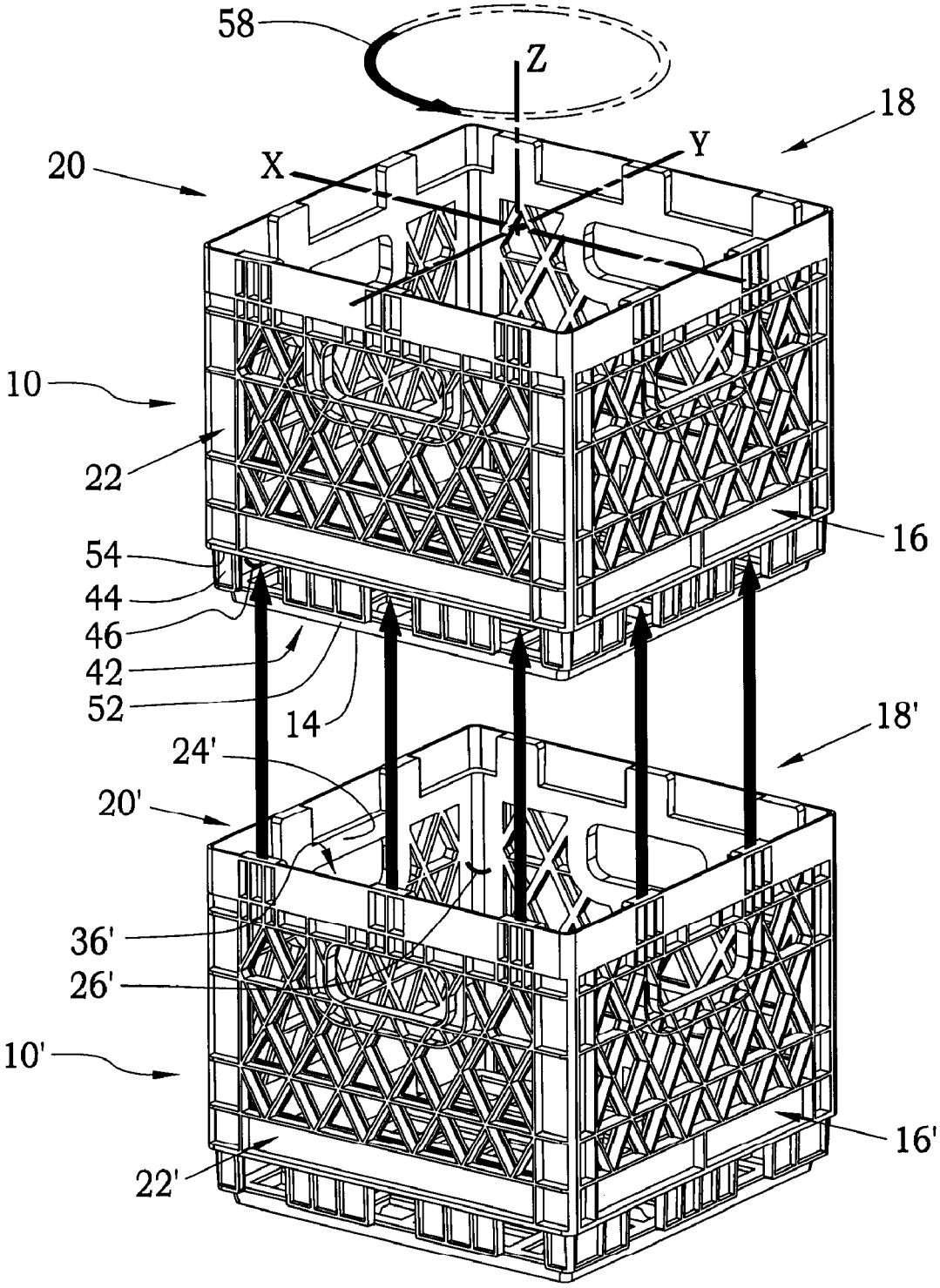
FIG. 8 is an exploded perspective view of two of the two stacking position square container illustrated in FIG. 1 being stacked in a lower stacking position.
Figure 9:
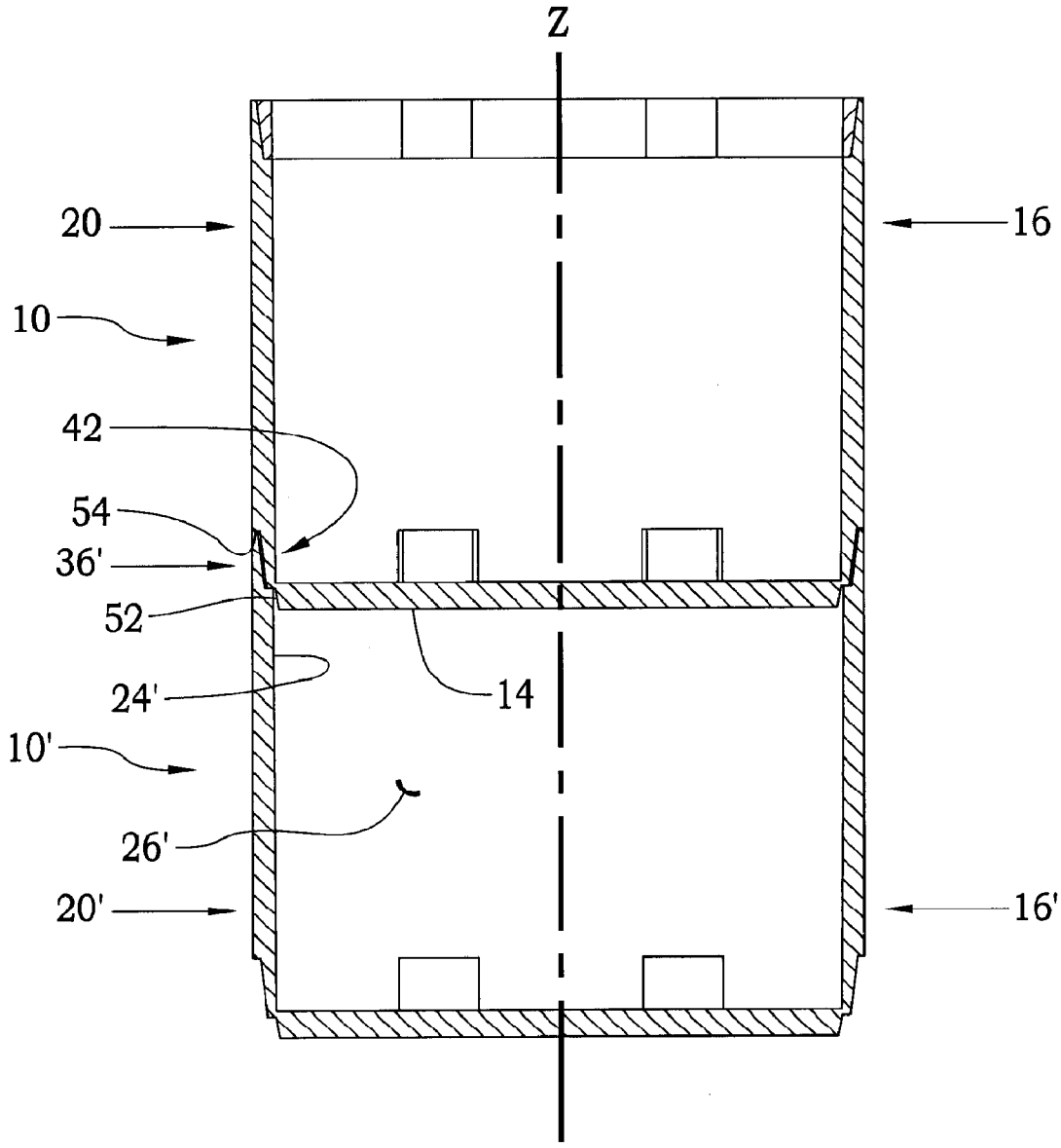
FIG. 9 is a side elevation view, in section, of the lower stacking position illustrated in FIG. 8.

Referring to FIG. 1, FIG. 2 and FIG. 3, an x axis and a y axis have been illustrated. It is preferred that body 12 be symmetrical about both the x axis and the y axis. Referring to FIG. 1 top interior profile 36 of side wall 16 is made identical to top interior profile 36 of opposed side wall 20. Referring to FIG. 1, bottom exterior profile 42 of side wall 16 is made identical to bottom exterior profile 42 of opposed side wall 20, illustrated in FIG. 4. Referring to FIG. 1 top interior profile 36 of side wall 18 is made identical to top interior profile 36 of opposed side wall 22. Referring to FIG. 1, bottom exterior profile 42 of side wall 18 is made identical to bottom exterior profile 42 of opposed side wall 22, illustrated in FIG. 5. Referring to FIG. 8, bottom exterior profile 42 of side walls 18 and 22 are configured to mate with top interior profile 36 of side walls 18 and 22. Similarly, bottom exterior profile 42 of side walls 16 and 20 are configured to mate with top interior profile of side walls 16 and 20.

It is preferred that hand openings 56 be provided in each of side walls 16, 18, 20, 22 to facilitate manual handling.

Operation:

The use and operation of two stacking position square container 10 will now be described with reference to FIG. 1 through FIG. 11. Where the relationship between two of two stacking position square containers 10 is to be described, the containers will be designated as 10 and 10' for purposes of differentiation. All of the elements of container 10' will be assigned identical reference numerals and designated as 12', 14', 16', etc for purposes of differentiation.

Figure 6:
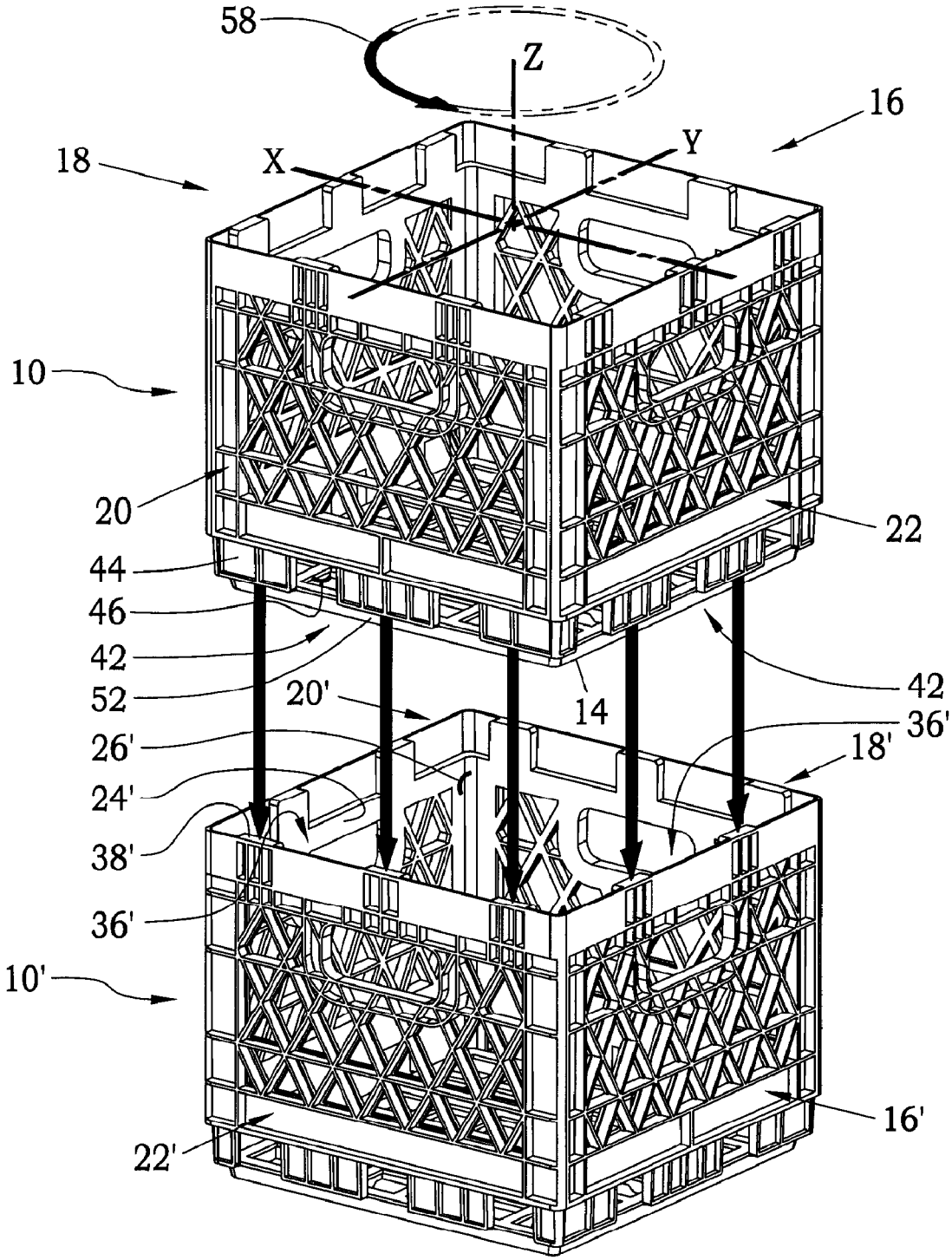
FIG. 6 is an exploded perspective view of two of the two stacking position square container illustrated in FIG. 1 being stacked in an upper stacking position.
Figure 7:
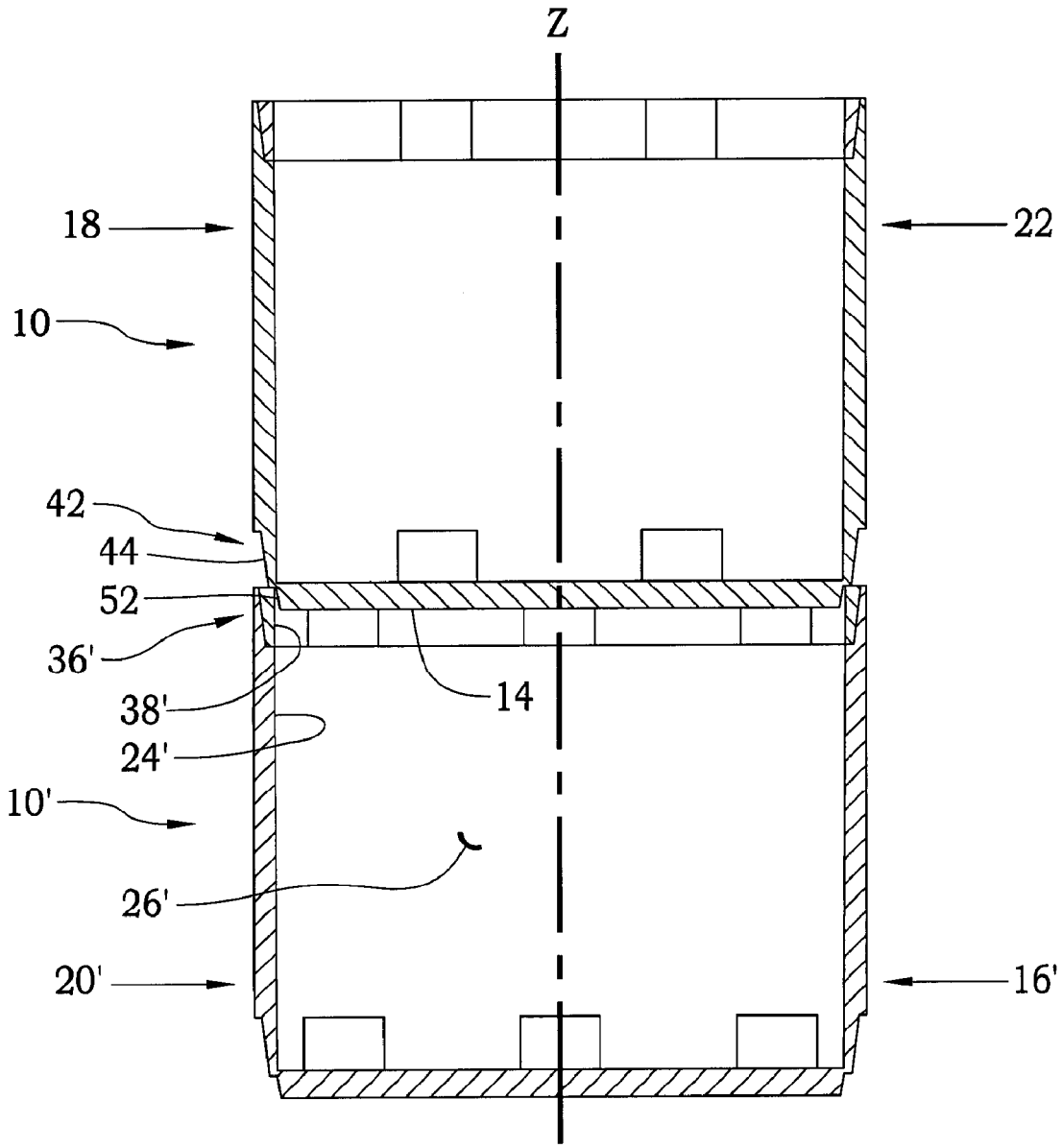
FIG. 7 is a side elevation view, in section, of the upper stacking position illustrated in FIG. 6.

Referring to FIG. 6 and FIG. 7, an upper stacking position is illustrated. In this upper stacking position, bottom 14 of container 10 is inserted into square opening 24' of container 10'. Support members 44 of bottom exterior profile 42 of container 10 rest upon supports members 38' of top interior profile 36' of container 10'. This engagement between support members 44 and support members 38' prevents bottom 14 of container 10 from penetrating further into interior storage cavity 26' of container 10'. Peripheral band 52 surrounding bottom 14 of container 10 engages square opening 24' to provide lateral stability.

Referring to FIG. 6 and FIG. 8, a z axis has been illustrated. A 90 degree relative rotation, indicated by arrow 58, about the z axis is used to change between the upper stacking position illustrated in FIG. 6 and FIG. 7 and a lower stacking position, illustrated in FIG. 8 and FIG. 9. In the lower stacking position, support members 44 and recesses 46 on bottom exterior profile 42 of side walls 18 and 22 of container 10 mate with top interior profile 36' of side walls 18' and 22' of container 10'. Similarly, support members 44 and recesses 46 on bottom exterior profile 42 of side walls 16 and 20 mate with top interior profile 36' of side walls 16' and 20' of container 10'. Second engagement shoulder 54 limits the depth of insertion of bottom exterior profile 42 into interior storage cavity 26' of container 10'. As with the upper stacking position, peripheral band 52 surrounding bottom 14 of container 10 engages square opening 24' to provide lateral stability.

Figure 10:
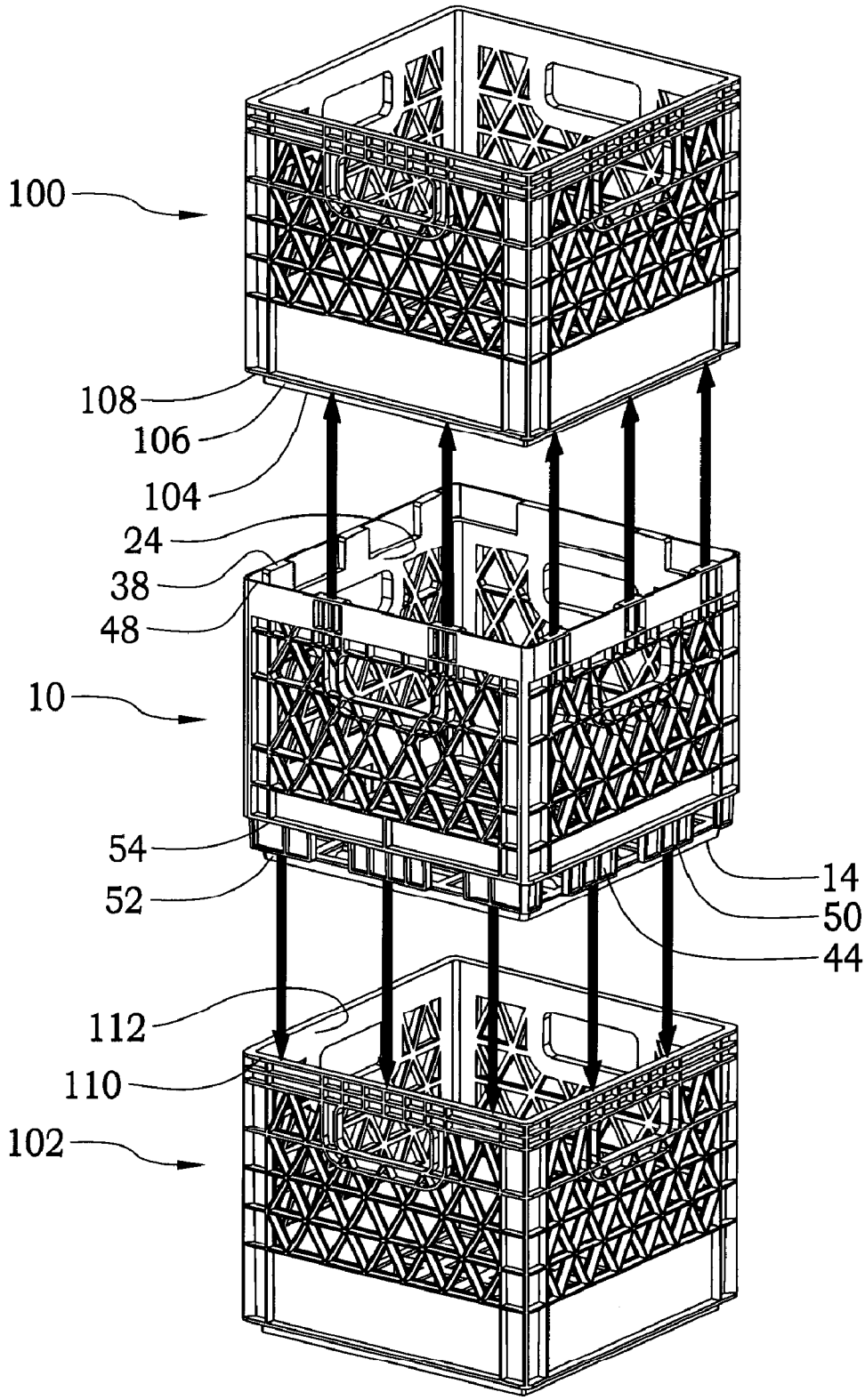
FIG. 10 is an exploded perspective view of the two stacking position square container illustrated in FIG. 1 being stacked between two single position square containers.
Figure 11:
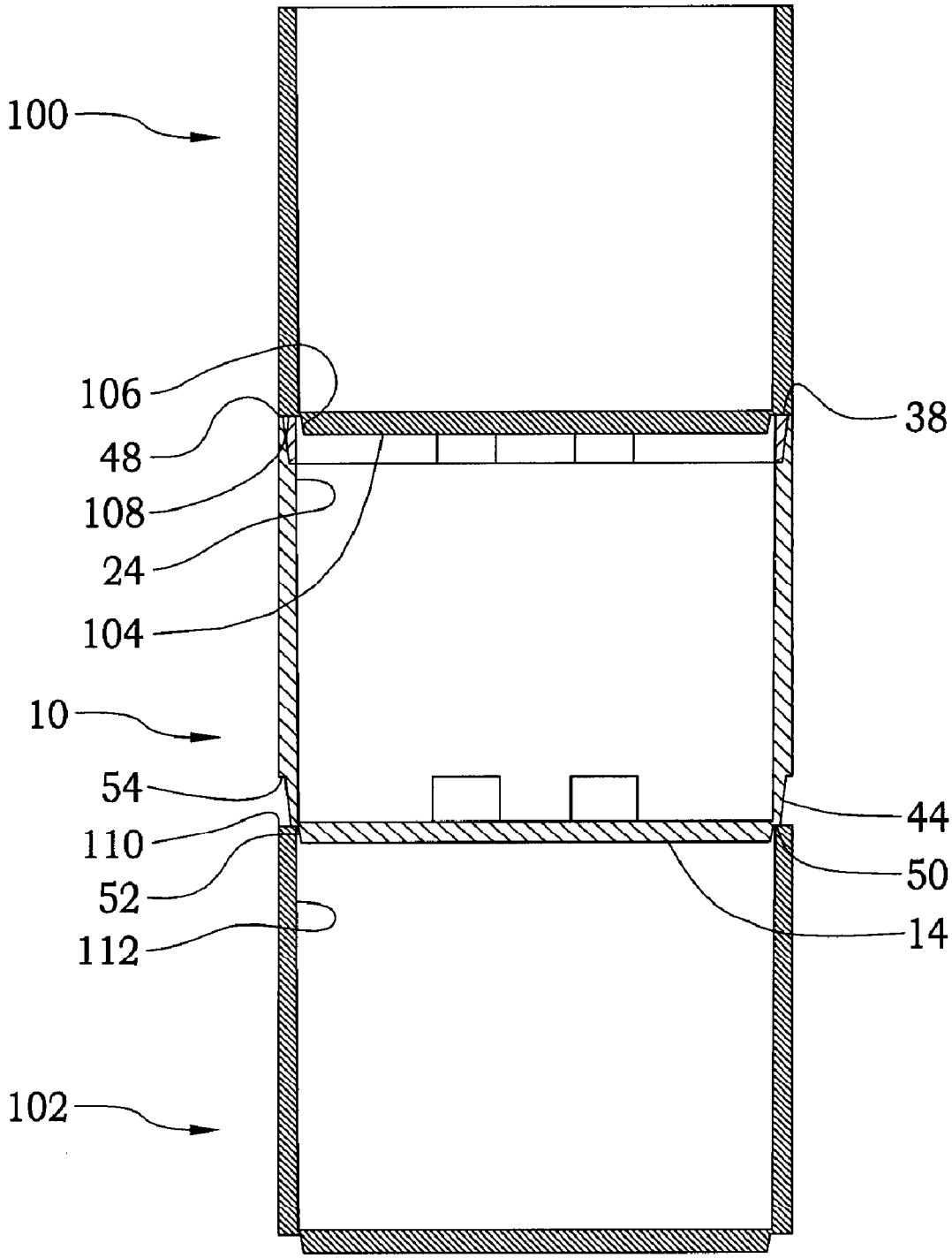
FIG. 11 is a side elevation view, in section, of stack of containers illustrated in FIG. 10.

Referring to FIG. 10 and FIG. 11, there is illustrated how two stacking position square container 10 can be stacked with single position containers. There is illustrated an overlying single position container 100 and an underlying single position container 102. Overlying single position container 100 has a bottom 104 with a recessed peripheral bottom band 106 (similar to bottom band 52) and an engagement shoulder 108, (not as deep as but similar to engagement shoulder 54). Engagement is effected by inserting bottom 104 of overlying single position container 100 into square opening 24 until top exterior profile 48 of container 10 engages engagement shoulder 108. Lateral stability is provided by bottom band 106 of overlying single position container 100 engaging square opening 24. Underlying single position container 102 has a top peripheral edge 110 defining a square opening 112. Stacking container 10 with underlying single position container 102 is effected by inserting bottom 14 into square opening 112 until first engagement surface 50 provided by the lower extremities of support members 44 engages top peripheral edge 110 of underlying single position container 102. Lateral stability is provided by bottom band 52 engaging square opening 112.

Advantages:

Although two stacking position square container 10 was developed to suit the needs of the dairy industry, it is a multipurpose reusable container that can be used for numerous shipping, handling and storage applications. The square containers previously used by the dairy industry were made in a single size to accommodate the largest products contemplated. This resulted in wasted empty space when the product did not fill the interior cavity to its full height. Two stacking position square container 10 provides two stacking heights, which saves space when dealing with shorter products or returning empty containers. In addition, two stacking position square container 10 has been designed to work with existing single position containers. This allows users to gradually replace their inventory of single position containers with two stacking position square containers, as the single position containers need replacement. The 90 degree rotation is a simpler movement when adapting for automated systems. Even with manual handling, it is easier for a worker to manage a 90 degree rotation with a heavily loaded container, than a 180 degree rotation as is known in the bakery industry. 180 degree rotation has not been problem in the bakery industry, as the weight of the product is considerably less. The two stacking position bakery containers do not have the structural strength to withstand the heavier weight demands of the dairy industry.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A two stacking position square container, comprising:

a one piece integrally moulded body having a bottom with four side walls of equal length and height extending upwardly from the bottom to define a square opening into a non-tapered interior storage cavity, each of the four side walls having an exterior surface, an interior surface, a top peripheral edge and a bottom peripheral edge, the interior surface being planar;

each of the four side walls having an intermittent top interior profile of supports and recesses along the top peripheral edge, wherein the supports are parallel-piped and do not extend past the interior surface of the four sidewalls into the interior storage cavity;

each of the four side walls having an intermittent bottom exterior profile of supports and recesses along the bottom peripheral edge;

an upper stacking position being provided by inserting a bottom of an identical body into the square opening to provide lateral stability and engaging the supports on the bottom exterior profile with the supports on the top interior profile;

a lower stacking position being provided by inserting the bottom of the identical body into the square opening to provide lateral stability and engaging the supports on the bottom exterior profile with the recesses on the top interior profile and the supports on the upper interior profile with the recesses on the bottom interior profile; and the body being symmetrical about both an x axis and a y axis with a 90 degree relative rotation about a z axis being used to change between the upper stacking position and the lower stacking position.

2. The two stacking position square container as defined in claim 1, wherein a continuous planar top exterior profile is provided along the top peripheral edge.

3. The two stacking position square container as defined in claim 1, wherein an engagement surface is spaced from the bottom peripheral edge of each of the side walls below the bottom exterior profile defining a peripheral engagement band around the body adjacent the bottom peripheral edge.

4. A two stacking position square container, comprising:

a one piece integrally moulded body having a bottom with four side walls of equal length and height extending upwardly from the bottom to define a square opening into a non-tapered interior storage cavity, each of the four side walls having an exterior surface, an interior surface, a top peripheral edge and a bottom peripheral edge, the interior surface being planar;

each of the four side walls having an intermittent top interior profile of support members separated by recesses along the top peripheral edge, wherein the supports are parallel-piped and do not extend past the interior surface of the four sidewalls into the interior storage cavity;

each of the four side walls having an intermittent bottom exterior profile of support members and recesses along the bottom peripheral edge;

a continuous planar top exterior profile along the top peripheral edge of each of the side walls;

an engagement surface spaced from the bottom peripheral edge of each of the side walls below the bottom exterior profile defining a peripheral engagement band around the body adjacent the bottom peripheral edge;

an upper stacking position being provided by inserting a bottom of an identical body into the square opening to provide lateral stability and engaging the support members on the bottom exterior profile with the support members on the top interior profile;

a lower stacking position being provided by inserting the bottom of the identical body into the square opening to provide lateral stability and engaging the support member on the bottom exterior profile with the recesses on the top interior profile and the support members on the upper interior profile with the recesses on the bottom interior profile;

the body being symmetrical about both an x axis and a y axis with a 90 degree relative rotation about a z axis being used to change between the upper stacking position and the lower stacking position;

stacking with an overlying single position container with a recessed peripheral bottom band and an engagement shoulder being effected by inserting the peripheral bottom band into the square opening with the engagement shoulder engaging the top exterior profile at the top peripheral edge; and stacking with an underlying single position container having a top peripheral edge defining a square opening being effected by inserting the bottom into the square opening of the single position container until the engagement surface engages the top peripheral edge of the single position container and the peripheral engagement band engages the top opening.

* * * * *